US007878211B2

(12) United States Patent
Gedevanishvili et al.

(10) Patent No.: US 7,878,211 B2
(45) Date of Patent: Feb. 1, 2011

(54) TOBACCO POWDER SUPPORTED CATALYST PARTICLES

(75) Inventors: Shalva Gedevanishvili, Richmond, VA (US); Ping Li, Glen Allen, VA (US); Firooz Rasouli, Midlothian, VA (US); Mohammad Hajaligol, Midlothian, VA (US)

(73) Assignee: Philip Morris USA Inc., Richmond, VA (US)

( * ) Notice: Subject to any disclaimer, the term of this patent is extended or adjusted under 35 U.S.C. 154(b) by 1373 days.

(21) Appl. No.: 11/341,497

(22) Filed: Jan. 30, 2006

(65) Prior Publication Data

US 2006/0196517 A1 Sep. 7, 2006

Related U.S. Application Data

(60) Provisional application No. 60/649,568, filed on Feb. 4, 2005.

(51) Int. Cl.
*A24B 15/00* (2006.01)

(52) U.S. Cl. ..... 131/352

(58) Field of Classification Search ..... None
See application file for complete search history.

(56) References Cited

U.S. PATENT DOCUMENTS

| | | | | |
|---|---|---|---|---|
| 3,720,214 | A | 3/1973 | Norman et al. | |
| 3,807,416 | A | 4/1974 | Hedge et al. | |
| 3,931,824 | A | 1/1976 | Miano et al. | |
| 4,055,191 | A | 10/1977 | Norman et al. | |
| 4,108,151 | A | 8/1978 | Martin et al. | |
| 4,109,663 | A | 8/1978 | Maeda et al. | |
| 4,119,104 | A | 10/1978 | Roth | |
| 4,182,348 | A | 1/1980 | Seehofer et al. | |
| 4,195,645 | A | 4/1980 | Bradley, Jr. et al. | |
| 4,197,861 | A | 4/1980 | Keith | |
| 4,248,251 | A | 2/1981 | Bryant, Jr. et al. | |
| 4,450,847 | A | 5/1984 | Owens | |
| 4,453,553 | A | 6/1984 | Cohn | |
| 4,489,739 | A | 12/1984 | Mattina et al. | |
| 4,744,374 | A | 5/1988 | Deffeves et al. | |
| 4,819,668 | A * | 4/1989 | Shelar et al. | 131/371 |
| 5,040,551 | A | 8/1991 | Schlatter et al. | |
| 5,101,839 | A | 4/1992 | Jakob et al. | |
| 5,105,836 | A | 4/1992 | Gentry et al. | |
| 5,129,408 | A | 7/1992 | Jakob et al. | |
| 5,211,684 | A | 5/1993 | Shannon et al. | |
| 5,284,166 | A | 2/1994 | Cartwright et al. | |

(Continued)

FOREIGN PATENT DOCUMENTS

| | | |
|---|---|---|
| WO | WO 87/06104 A1 | 10/1987 |

(Continued)

*Primary Examiner*—Philip C Tucker
*Assistant Examiner*—Michael J Felton
(74) *Attorney, Agent, or Firm*—Buchanan Ingersoll & Rooney PC

(57) ABSTRACT

Cut filler compositions, cigarettes, methods for making cut filler compositions and cigarettes, and methods for treating mainstream tobacco smoke of cigarettes are provided that use catalyst particles capable of converting carbon monoxide to carbon dioxide. The catalyst particles are supported on tobacco powder. The tobacco powder supported catalyst particles can be prepared by dry admixing the catalyst particles and tobacco powder or by combining a dispersion of catalyst particles with the tobacco powder.

5 Claims, 3 Drawing Sheets

U.S. PATENT DOCUMENTS

| | | | | |
|---|---|---|---|---|
| 5,322,075 | A | 6/1994 | Deevi et al. | |
| 5,386,838 | A | 2/1995 | Quincy, III et al. | |
| 5,591,368 | A | 1/1997 | Fleischhauer et al. | |
| 5,598,868 | A | 2/1997 | Jakob et al. | |
| 5,671,758 | A | 9/1997 | Rongved | |
| 5,728,462 | A | 3/1998 | Arino et al. | |
| 5,934,289 | A | 8/1999 | Watkins et al. | |
| 6,053,176 | A | 4/2000 | Adams et al. | |
| 6,095,152 | A | 8/2000 | Beven et al. | |
| 6,138,684 | A | 10/2000 | Yamazaki et al. | |
| 6,164,287 | A | 12/2000 | White | |
| 6,265,341 | B1 | 7/2001 | Komatsu et al. | |
| 6,286,516 | B1 | 9/2001 | Bowen et al. | |
| 6,371,127 | B1 | 4/2002 | Snaidr et al. | |
| 6,782,892 | B2 * | 8/2004 | Li et al. | 131/364 |
| 2002/0002979 | A1 | 1/2002 | Bowen et al. | |
| 2002/0062834 | A1 | 5/2002 | Snaidr et al. | |
| 2003/0000538 | A1 * | 1/2003 | Bereman | 131/352 |
| 2003/0005940 | A1 | 1/2003 | Dyakonov et al. | |
| 2003/0037792 | A1 | 2/2003 | Snaidr et al. | |
| 2003/0075193 | A1 | 4/2003 | Li et al. | |
| 2006/0174902 | A1 * | 8/2006 | Zhou et al. | 131/352 |

FOREIGN PATENT DOCUMENTS

| | | | |
|---|---|---|---|
| WO | WO 00/40104 | A1 | 7/2000 |
| WO | WO 02/24005 | A2 | 3/2002 |

* cited by examiner

TOBACCO POWDER SUPPORTED CATALYST PARTICLES

This application claims priority under 35 U.S.C. 119 to U.S. Provisional Application No. 60/649,568, entitled Tobacco Powder Supported Catalyst Particles, filed on Feb. 4, 2005, the entire content of which is hereby incorporated by reference.

BACKGROUND

In the description that follows reference is made to certain structures and methods, however, such references should not necessarily be construed as an admission that these structures and methods qualify as prior art under the applicable statutory provisions. Applicants reserve the right to demonstrate that any of the referenced subject matter does not constitute prior art.

Smoking articles, such as cigarettes or cigars, produce both mainstream smoke during a puff and sidestream smoke. One constituent of both mainstream smoke and sidestream smoke is carbon monoxide (CO). The reduction of carbon monoxide in smoke is desirable.

Despite the developments to date, there remains an interest in improved and more efficient methods and compositions for reducing the amount of carbon monoxide in the mainstream smoke of a smoking article during smoking.

SUMMARY

Tobacco cut filler compositions, cigarettes and methods for making cigarettes incorporating tobacco powder supported catalyst particles are described herein.

One embodiment provides a cut filler composition comprising tobacco and an admixture comprising catalyst particles and tobacco powder particles, wherein the catalyst particles are supported on the tobacco powder particles.

Another embodiment provides a cigarette comprising tobacco cut filler and cigarette paper, wherein at least one of the tobacco cut filler and cigarette paper includes an admixture comprising catalyst particles supported on tobacco powder particles.

A further embodiment provides a method of making a cigarette, comprising combining catalyst particles with tobacco powder particles to form an admixture comprising catalyst particles supported on the tobacco powder particles; incorporating the admixture on and/or in at least one of tobacco cut filler and cigarette paper; providing the cut filler to a cigarette making machine to form a tobacco column; and placing the paper around the tobacco column to form a tobacco rod of a cigarette.

In another embodiment, the catalyst particles comprise one or more metallic elements selected from the group consisting of Group IB, IIB, IIIB, IVB, VB, VIIB, VIIB, VIII, IIIA and IVA elements of the Periodic Table of Elements. For example, the catalyst particles can comprise metal oxides selected from the group consisting of copper manganese spinel, manganese oxide, iron oxide, copper oxide, cerium oxide and mixtures thereof.

The catalyst particles can have a specific surface area of from about 10 to 2500 $m^2/g$ and an average particle size of less than about 5 μm, or less than about 1 μm. The tobacco powder particles can have an average particle size of less than or equal to about 500 microns. The admixture, which comprises catalyst particles supported on tobacco powder particles, preferably comprises a dry admixture. According to an embodiment, the catalyst particles and the tobacco powder particles can be combined in the absence of a liquid. According to a further embodiment, an admixture comprising catalyst particles supported on tobacco powder particles can be incorporated on and/or in tobacco cut filler and/or cigarette paper in the absence of a liquid. Preferably, the catalyst particles substantially cover the surface of the tobacco powder particles. The admixture can comprise from about 0.1 to 50 wt. %, preferably from about 10 to 30 wt. % catalyst particles supported on tobacco powder particles.

The tobacco powder supported catalyst particles can be added to a cigarette in an amount effective to convert at least 10% of the carbon monoxide in the mainstream smoke to carbon dioxide. For example, up to about 200 mg of the catalyst particles can be added to each cigarette. The admixture can be combined with the tobacco cut filler and/or cigarette paper by dusting the admixture onto the tobacco cut filler and/or cigarette paper.

According to a further embodiment, the admixture can be formed by combining catalyst particles with a liquid to form a dispersion; combining the dispersion with the tobacco powder particles; and drying the tobacco powder particles to remove the liquid and deposit the catalyst particles on and/or incorporate the catalyst particle in the tobacco powder particles.

To form a dispersion, catalyst particles can be combined with a liquid selected from the group consisting of distilled water, ethyl alcohol, methyl alcohol, chloroform, aldehydes, ketones, aromatic hydrocarbons, hexanes and mixtures thereof. According to a preferred embodiment, the dispersion can be sprayed onto the tobacco powder particles.

Yet another embodiment provides a method of treating mainstream smoke of the cigarette described above, comprising lighting the cigarette to form smoke and drawing the smoke through the cigarette, wherein the catalyst particles act as a catalyst and/or oxidant for the conversion of carbon monoxide to carbon dioxide.

BRIEF DESCRIPTION OF THE DRAWING FIGURES

DETAILED DESCRIPTION OF PREFERRED EMBODIMENTS

Figure 1:
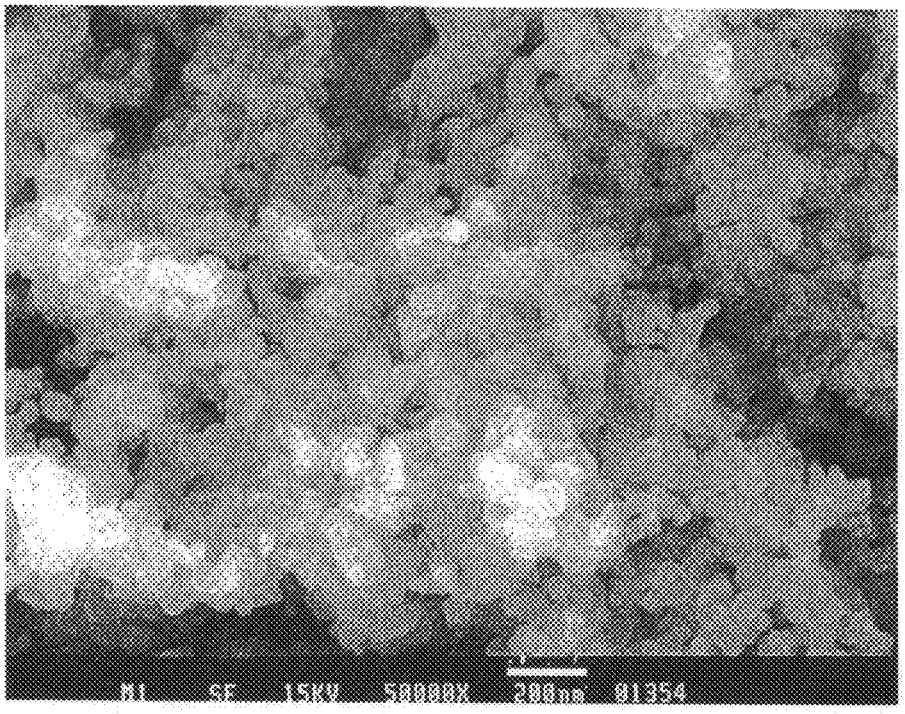
FIG. 1 shows an SEM micrograph of black pigment catalyst particles.

Tobacco cut filler compositions, cigarettes, methods for making cigarettes and methods for treating mainstream smoke of cigarettes incorporating tobacco powder supported catalyst particles are described herein. The supported catalyst particles, which can be incorporated in a component of a cigarette such as tobacco cut filler and/or cigarette paper of a cigarette, can act as a catalyst and/or oxidant for the conversion of carbon monoxide (CO) to carbon dioxide ($CO_2$). By incorporating the tobacco powder supported catalyst particles into a component of a cigarette, the amount of carbon monoxide in mainstream smoke can be reduced.

A catalyst is capable of affecting the rate of a chemical reaction, e.g., increasing the rate of oxidation of carbon monoxide to carbon dioxide. An oxidant is capable of oxidizing a reactant, e.g., by donating oxygen to the reactant, such that the oxidant itself is reduced.

"Smoking" of a cigarette means the heating or combustion of the cigarette to form smoke, which can be drawn through the cigarette. Generally, smoking of a cigarette involves lighting one end of the cigarette and, while the tobacco contained therein undergoes a combustion reaction, drawing the cigarette smoke through the mouth end of the cigarette. The cigarette may also be smoked by other means. For example, the cigarette may be smoked by heating the cigarette and/or heating using electrical heater means, as described in commonly-assigned U.S. Pat. Nos. 6,053,176; 5,934,289; 5,591,368 and 5,322,075.

The term "mainstream" smoke refers to the mixture of gases passing down the tobacco rod and issuing through the filter end, i.e., the amount of smoke issuing or drawn from the mouth end of a cigarette during smoking of the cigarette.

In addition to the constituents in the tobacco, the temperature and the oxygen concentration within the cigarette during smoking are factors affecting the formation and reaction of carbon monoxide and carbon dioxide. For example, the total amount of carbon monoxide formed during smoking comes from a combination of three main sources: thermal decomposition (about 30%), combustion (about 36%) and reduction of carbon dioxide with carbonized tobacco (at least 23%). Formation of carbon monoxide from thermal decomposition, which is largely controlled by chemical kinetics, starts at a temperature of about 180° C. and finishes at about 1050° C. Formation of carbon monoxide and carbon dioxide during combustion is controlled largely by the diffusion of oxygen to the surface ($k_a$) and via a surface reaction ($k_b$). At 250° C., $k_a$ and $k_b$, are about the same. At 400° C., the reaction becomes diffusion controlled. Finally, the reduction of carbon dioxide with carbonized tobacco or charcoal occurs at temperatures around 390° C. and above.

During smoking there are three distinct regions in a cigarette: the combustion zone, the pyrolysis/distillation zone, and the condensation/filtration zone. While not wishing to be bound by theory, it is believed that the catalyst can target the various reactions that occur in different regions of the cigarette during smoking.

First, the combustion zone is the burning zone of the cigarette produced during smoking of the cigarette, usually at the lighted end of the cigarette. The temperature in the combustion zone ranges from about 700° C. to about 950° C., and the heating rate can be as high as 500° C./second. Because oxygen is being consumed in the combustion of tobacco to produce carbon monoxide, carbon dioxide, nitric oxide, water vapor, and various organic compounds, the concentration of oxygen is low in the combustion zone. The low oxygen concentration coupled with the high temperature leads to the reduction of carbon dioxide to carbon monoxide by the carbonized tobacco. In this region, the tobacco powder supported catalyst particles can convert carbon monoxide to carbon dioxide via both catalysis and oxidation mechanisms. The combustion zone is highly exothermic and the heat generated is carried to the pyrolysis/distillation zone.

The pyrolysis zone is the region behind the combustion zone, where the temperatures range from about 200° C. to about 600° C. The pyrolysis zone is where most of the carbon monoxide is produced. The major reaction is the pyrolysis (i.e. the thermal degradation) of the tobacco that produces carbon monoxide, carbon dioxide, nitric oxide, smoke components, and charcoal using the heat generated in the combustion zone. There is some oxygen present in this region, and thus the tobacco powder supported catalyst particles may act as a catalyst for the oxidation of carbon monoxide to carbon dioxide. The catalytic reaction begins at 150° C. and reaches maximum activity around 300° C.

In the condensation/filtration zone the temperature ranges from ambient to about 150° C. The major process in this zone is the condensation/filtration of the smoke components. Some amount of carbon monoxide and carbon dioxide diffuse out of the cigarette and some oxygen diffuses into the cigarette. The partial pressure of oxygen in the condensation/filtration zone does not generally recover to the atmospheric level.

The catalyst particles are supported in and/or on tobacco powder particles. The catalyst particles can comprise metallic elements selected from the group consisting of Group IB-VIIB, VII, IIIA and IVA elements of the Periodic Table of Elements, and mixtures thereof, e.g., B, C, Mg, Al, Si, Ti, V, Cr, Mn, Fe, Co, Ni, Cu, Zn, Ge, Y, Zr, Nb, Mo, Ru, Rh, Pd, Ag, Sn, Ce, Hf, Ta, W, Re, Os, Ir, Pt and Au. The catalyst particles can be in the form of metal or mixed metal oxides, hydroxies, or mixtures thereof. The tobacco powder supported catalyst particles comprise an admixture that can be combined with tobacco cut filler and/or cigarette paper. Preferably, a substantially dry admixture is added to the tobacco cut filler and/or cigarette paper.

Catalyst particles can be used with a particle size of up to 5 microns. The catalyst particles can have an average particle size less than about 1 μm, preferably less than about 300 nm, most preferably less than about 50 nm. Catalyst particles have very high surface area to volume ratios, which makes them attractive for catalytic applications. Additionally, smaller catalyst particles can be more easily supported on tobacco powder particles and can cover more of the surface of a tobacco powder particle because of its size.

By dispersing catalyst particles on tobacco powder particles, the catalyst particles are easier to handle and easier to combine with tobacco cut filler and/or cigarette paper than unsupported catalyst particles. This is especially true for smaller catalyst particles, wherein the tobacco powder particles size, friability, etc. can aid in the handling of the catalyst particles.

Catalyst particles can be combined with tobacco powder particles and tobacco cut filler before and/or during incorporation of the tobacco cut filler into a cigarette. The tobacco powder particles can act as a separator, and can inhibit agglomeration or sintering together of the catalyst particles during packing of the cigarette with the catalyst particles and cut filler and/or during combustion of the cut filler.

It is noted that particle sintering may disadvantageously elongate the combustion zone, which can result in excess carbon monoxide production. Thus, because the tobacco powder particles separate catalyst particles, the tobacco particles reduce catalyst particle sintering, and thus can reduce elongation of the combustion zone and a loss of active surface area of the catalyst particles.

Catalyst particles may be incorporated onto the tobacco powder particles by various techniques, such as physical admixture, liquid solubilizing mixture, etc. One exemplary physical admixture method includes directly combining dry catalyst particles with dry tobacco powder particles to form an admixture comprising an intimate mixture of catalyst particles supported on tobacco powder particles. By this physical admixture, physical surface adhesion and/or agglomeration of the smaller catalyst particles onto the tobacco powder particles can allow the catalyst particles to substantially cover the tobacco powder particles.

According to another embodiment, catalyst particles can be mixed with tobacco particles using liquid. For example, the catalyst particles can first be dispersed in a liquid, and then the tobacco powder particles can be mixed into the catalyst particle containing liquid. Alternatively, the tobacco powder particles may be sprayed or immersed with a liquid having the dispersed catalyst particles therein and can then be dried to form an intimate admixture of catalyst particles supported on the tobacco powder particles. The liquid can be substantially removed from the tobacco powder particles and the catalyst particles, wherein after substantially removing the liquid, the catalyst particles can remain on the tobacco powder particles such that the catalyst particles and the tobacco powder particles can be incorporated into tobacco cut filler or another portion of a cigarette. The liquid can be substantially removed, for example, by heating the tobacco powder particles at a temperature higher than the boiling point of the liquid or by reducing the pressure of the atmosphere surrounding the tobacco powder particles.

Exemplary liquids that can be used to form a dispersion of the catalyst particles can include, but is not limited to, distilled water, hexanes, aromatic hydrocarbons, methyl alcohol, ethyl alcohol, butyl alcohol, aldehydes, ketones, chloroform, mineral spirits, and mixtures thereof.

Preferably, the catalyst particles at least partially cover the surface of the tobacco powder particles to form an admixture. The admixture can comprise from about 0.1 to 50 wt. % catalyst particles, or from about 10 to 30 wt. % catalyst particles, supported on tobacco powder particles. By adjusting the loading of the catalyst particles on the tobacco powder particles, the activities of the catalyst/oxidant can be regulated.

Catalyst metal oxide powders are commercially available. For instance, MACH I, Inc. (King of Prussia, Pa.) markets iron oxide catalyst particles under the trade names NANOCAT® Superfine Iron Oxide (SFIO) and NANOCAT® Magnetic Iron Oxide. The NANOCAT® Superfine Iron Oxide (SFIO) is an amorphous ferric oxide in the form of a free flowing powder, with a particle size of about 3 nm, a specific surface area of about 250 $m^2/g$, and a bulk density of about 0.05 g/ml. The NANOCAT® Superfine Iron Oxide (SFIO) is synthesized by a vapor-phase process, which renders it free of impurities that may be present in conventional catalysts, and is suitable for use in food, drugs, and cosmetics. The NANOCAT® Magnetic Iron Oxide is a free flowing powder with a particle size of about 25 nm and a specific surface area of about 40 $m^2/g$. The Shepherd Color Company (Cincinnati, Ohio) markets catalyst oxide powders such as Black 444, which is a black pigment containing a mixture of copper manganese spinel and iron and manganese oxides. Based on elemental analysis, the Black 444 pigment includes 17.7 wt. % iron, 44.7 wt. % manganese and 37.6 wt. % copper. The Black 444 pigment includes individual and agglomerated particles in the size range of about 30 to 300 nm and has a specific surface area of about 20 $m^2/g$. A scanning electron microscope (SEM) micrograph of Black 444 pigment powder is shown in FIG. 1.

The tobacco powder particles can be produced by comminuting matured tobacco leaves, but can also be reclaimed from waste produced by conventional tobacco processing. The tobacco from which the tobacco powder particles are produced can be un-cured or cured. For example, tobacco powder particles can be prepared by grinding and sieving flue-cured Bright tobacco.

The tobacco powder particles can be sized as desired. For example, tobacco laminae and stem can be finely divided to preferred sizes. Preferably, the tobacco powder particles used as catalyst support have an average particle size of 1 to 1000 microns. In exemplary embodiments, tobacco powder particles have an average particle size of less than 500 microns (e.g., if larger catalysts are desired), less than 100 microns or less than 40 microns, though larger particles can be used.

The relative amounts of catalyst particles and tobacco powder particles in the admixture can vary. In general, catalyst particles and tobacco powder particles can be combined in any suitable ratio to give a desired loading of catalyst particles on the tobacco powder. For example, ratios of catalyst particles to tobacco powder can range from about 0.1 percent to about 50 percent, preferably about 10 percent to about 30 percent, on a dry weight basis. The tobacco powder particle can maintain its original volume after the catalyst particles are provided in intimate contact therewith and can be provided in an essentially dry form prior to the provision of catalyst particles. For example, catalyst iron oxide particles or copper oxide particles can be combined with tobacco powder particles to produce from about 0.1% to 50% wt. %, e.g., at least 5 wt. %, 10 wt. %, 20 wt. %, 30 wt. % or 40 wt. % catalyst particles of iron oxide or copper oxide supported on the tobacco powder particles.

The amount of catalyst particles added to a cigarette can vary. For example, the amount of the admixture (e.g., the mixture of catalyst particles supported on tobacco powder particles) can be at least about 5% by weight, if less catalytic activity is desired, or can be higher, at levels between about 10 to 20%, if desired, of the tobacco cut filler in a cigarette. By way of a non-limiting example, cigarettes can comprise up to about 200 mg or more of the catalyst particles per cigarette or about 250 mg or more of the admixture per cigarette.

By way of example, 250 g of Black 444 is incorporated via dry admixture with 500 g of flue-cured Bright tobacco ground and sieved to a particle size of about 40-60 mesh (about 250 to 420 μm). The sample is placed in a programmable quartz tube furnace between pieces of quartz wool. Both the temperature of the sample and the temperature of the furnace are monitored via thermocouples. Gas flow into the tube furnace is controlled using Hastings digital flow meters. A gas mixture comprising 21% $O_2$ (balance He) is passed over the sample at a flow rate of 1000 sccm and the sample is pyrolyzed by heating the furnace at a constant heating rate of 15° C./min. from room temperature to about 800° C. Gas flow out of the furnace is filtered by a fiberglass filter pad and then fed into an online multichannel gas analyzer available from Rosemount Analytical (Model NGA2000-MLT) that measures the composition of CO, $CO_2$ and $O_2$ in the effluent gas. For comparison, the concentration of gases emitted from a 500 mg sample of identically prepared tobacco powder (no catalyst) is also measured.

Figure 2:
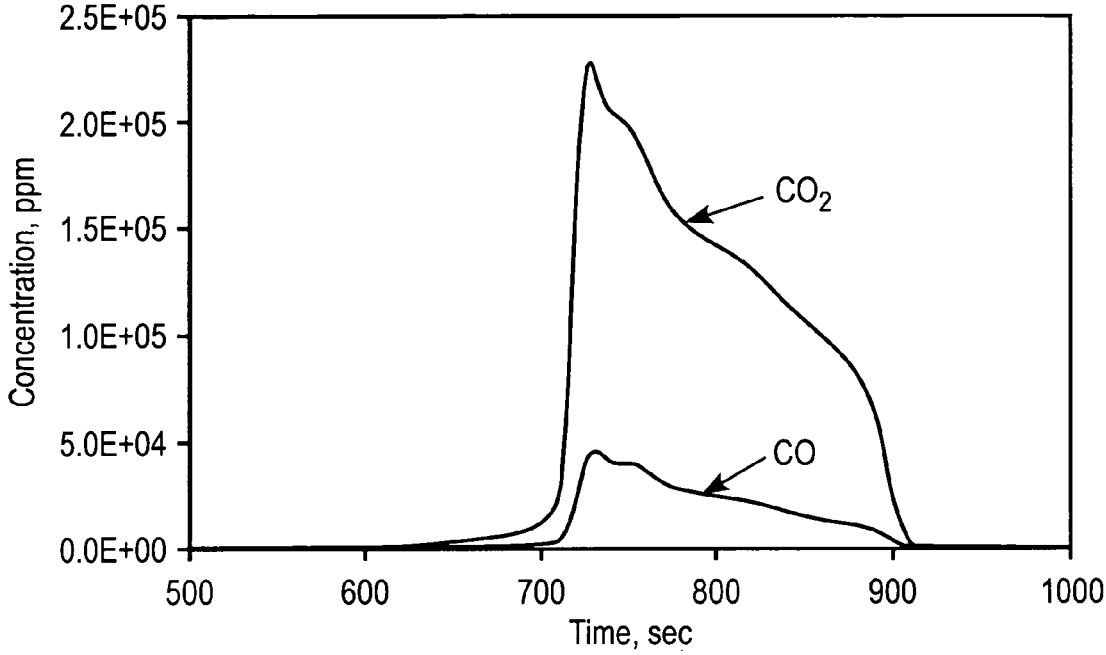
FIG. 2 shows CO and $CO_2$ gas concentrations emitted from a tobacco powder supported catalyst sample during oxidative pyrolysis.
Figure 3:
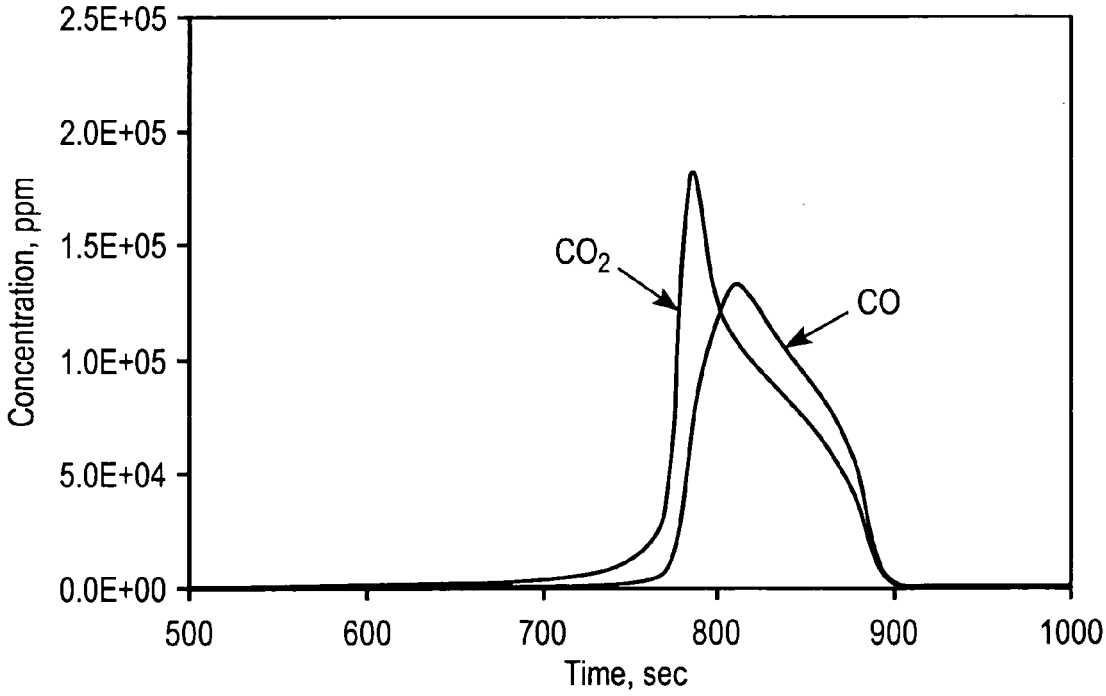
FIG. 3 shows CO and $CO_2$ gas concentrations emitted from a tobacco powder sample during oxidative pyrolysis.
Figure 4:
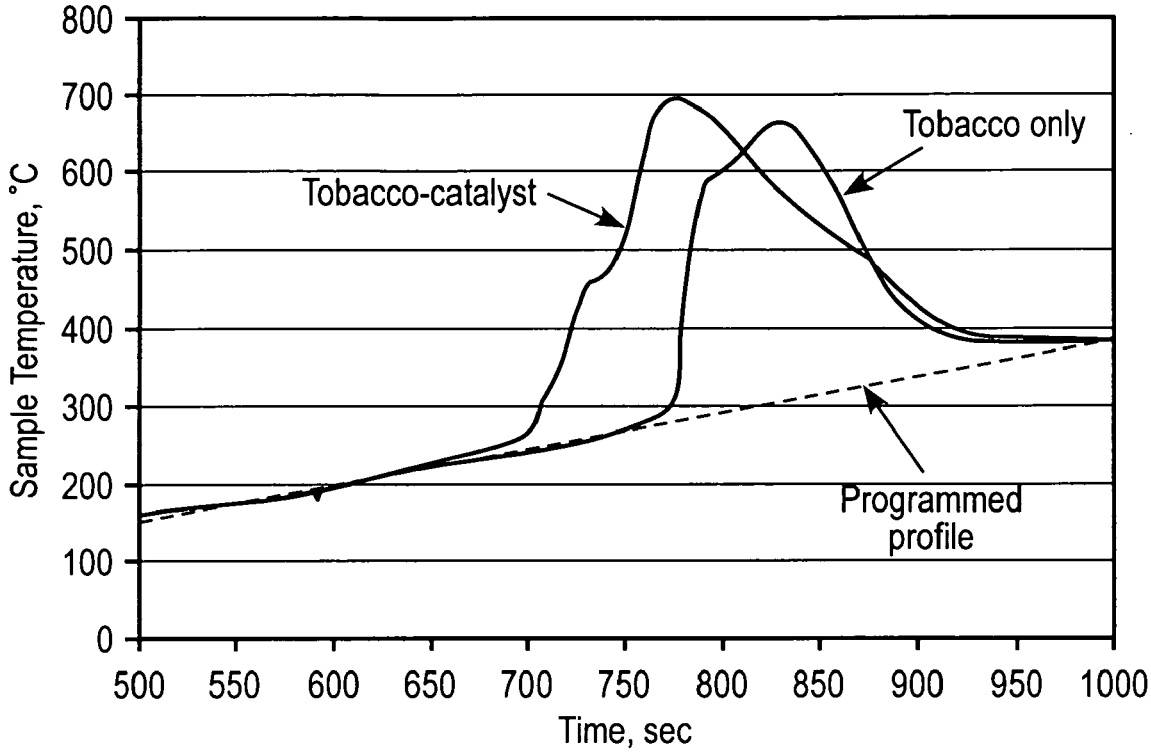
FIG. 4 shows the furnace temperature and sample temperature during the oxidative pyrolysis of a tobacco powder supported catalyst sample and a tobacco powder sample.

Concentration profiles for CO and $CO_2$ are shown in FIGS. 2 and 3 for the pyrolysis of tobacco powder particles incorporated with Black 444 catalyst (FIG. 2), as formed above, and for tobacco powder particles only (FIG. 3) for comparison as noted above. The ratio of $CO/CO_2$ for the sample comprising catalyst particles supported on tobacco powder is about 0.17 while the ratio of $CO/CO_2$ for the sample comprising tobacco powder particles only is about 0.86. Thus, the supported catalyst appears to significantly reduce the $CO/CO_2$ ratio. Additionally, FIG. 4 shows the furnace and sample temperatures for each of the test runs. As shown in FIG. 4, the sample temperatures during each measurement exceed the programmed furnace temperature. In the case of the tobacco/catalyst pyrolysis the sample temperature starts to increase earlier and sustains a value greater than the programmed furnace temperature longer than for tobacco pyrolysis only. Thus, comparing the tobacco powder particles sample with the tobacco powder particles incorporated with Black 444 catalyst, a 56% decrease in the measured output of CO and a 52% increase in the measured output of $CO_2$ upon pyrolysis can be attained.

It is noted that during the conversion of CO to $CO_2$, the material of the catalyst particles can be reduced. For example, catalyst $Fe_2O_3$ particles can be reduced to $Fe_3O_4$, FeO or Fe during the reaction of CO to $CO_2$. However, by using the tobacco powder particles as support, the tobacco powder particles can advantageously act as a spacer between the catalyst particles and prevent them from agglomerating together, which would result in a loss of surface area and catalytic activity; and thus reduction can be less of a potential problem. Additionally, by supporting the catalyst particles on tobacco powder particles the adhesion of the catalyst particles to cut filler and/or cigarette paper can be improved and the possibility of entrainment of the catalyst particles during smoking can be reduced.

While other catalysts can be used, preferred catalyst particles include iron oxide catalyst particles because iron oxide can have a dual function as a CO catalyst in the presence of oxygen, and as a CO oxidant for direct oxidation of CO in the absence of oxygen. Preferably, exemplary catalysts can also be used as an oxidant, which can be especially useful for certain applications, such as within a burning cigarette where the oxidation characteristics can be utilized if the partial pressure of oxygen in the cigarette is low. Catalyst particles, such as iron oxide particles, can also act as a catalyst for the conversion of CO to $CO_2$ according to the equation $2CO+O_2 \rightarrow 2CO_2$. For example, catalyst iron oxide particles can act as an oxidant for the conversion of CO to $CO_2$ according to the equation $3CO+F_2O_3 \rightarrow 3CO_2+2Fe$.

As mentioned above, catalyst particles may be capable of acting as both an oxidant for the conversion of carbon monoxide to carbon dioxide and as a catalyst for the conversion of carbon monoxide to carbon dioxide, wherein such actions can be cigarette location specific. For example, catalyst particles can act as a catalyst in the pyrolysis zone and can act as an oxidant in the combustion zone.

The supported catalyst particles can be distributed throughout or only in a portion of the tobacco rod portion of a cigarette. By providing supported catalyst particles throughout the tobacco rod, it is possible to reduce the amount of carbon monoxide drawn through the cigarette, and particularly at both the combustion region and in the pyrolysis zone. Alternatively, by providing supported catalyst particles in only a portion of the tobacco rod, less catalyst can be used as desired.

An admixture of catalyst particles supported on tobacco powder particles can be provided along the length of a tobacco rod by distributing the admixture on a pre-formed tobacco rod incorporating the admixture into cut filler tobacco prior to forming a tobacco rod, incorporating the admixture into cigarette paper, or placing the admixture on surfaces of cigarette paper. For example, the admixture can be added to a tobacco rod prior to wrapping cigarette paper around a tobacco rod (e.g. mixing or dusting the admixture in or on the tobacco rod) or added to cut filler tobacco stock supplied to a cigarette making machine. According to an exemplary embodiment, a dry admixture of catalyst particles supported on tobacco powder particles can be combined directly with tobacco cut filler prior to providing the cut filler to a cigarette making machine for form a tobacco column. Alternatively, during cigarette paper manufacture, the admixture can be added in an amount that does not inhibit the properties of the cigarette paper (e.g., burning rate, taste, etc.), or after cigarette paper manufacture, the admixture can be placed on a surface or a portion of the surface of the cigarette paper (e.g., dusting the admixture on to the paper).

The amount of the admixture can be selected such that the amount of carbon monoxide in mainstream smoke is reduced during smoking of a cigarette. Preferably, the amount of the admixture will be a catalytically effective amount, e.g., more than 1 mg, for example, about 80 to 250 mg/cigarette can lead to significant CO reduction.

One embodiment provides a cut filler composition comprising cut filler and an admixture of tobacco powder particles and catalyst particles, as described above, wherein the admixture is capable of converting carbon monoxide to carbon dioxide, upon combustion of the cut filler composition.

Any suitable tobacco mixture may be used for the cut filler. Examples of suitable types of tobacco materials include flue-cured, Burley, Md. or Oriental tobaccos, the rare or specialty tobaccos, and blends thereof. The tobacco material can be provided in the form of tobacco lamina, processed tobacco materials, such as volume expanded or puffed tobacco, processed tobacco stems, such as cut-rolled or cut-puffed stems, reconstituted tobacco materials, or blends thereof. The cut filler can also include tobacco substitutes if desired.

In cigarette manufacture, tobacco is normally employed in the form of cut filler, i.e. in the form of shreds or strands cut into widths ranging from about 1/10 inch to about 1/20 inch or even 1/40 inch. The lengths of the shreds or strands can range from between about 0.25 inches to about 3.0 inches. Additionally, cigarettes can also further include one or more flavorants or other additives (e.g. burn additives, combustion modifying agents, coloring agents, binders, etc.) as desired.

Another embodiment provides a cigarette with tobacco cut filler and cigarette paper, wherein at least one of the tobacco cut filler and cigarette paper includes an admixture comprising catalyst particles supported on tobacco powder particles.

A further embodiment provides a method of making a cigarette, comprising combining catalyst particles with tobacco powder particles to form an admixture comprising catalyst particles supported on the tobacco powder particles; incorporating the admixture on and/or in at least one of tobacco cut filler and cigarette paper; providing the cut filler to a cigarette making machine to form a tobacco column; and placing the paper around the tobacco column to form a tobacco rod of a cigarette.

Techniques for cigarette manufacture are known in the art. Any conventional or modified cigarette making technique may be used to incorporate the admixture. The resulting cigarettes can be manufactured to any known specifications using standard or modified cigarette making techniques and equipment. Typically, the cut filler composition is optionally combined with other cigarette additives, and provided to a cigarette making machine to produce a tobacco rod, which is then wrapped in cigarette paper, and optionally tipped with filters.

Cigarettes may range from about 50 mm to about 120 mm in length. The circumference is from about 15 mm to about 30 mm in circumference, and preferably around 25 mm. The tobacco packing density is typically between the range of about 100 $mg/cm^3$ to about 300 $mg/cm^3$, and preferably 150 $mg/cm^3$ to about 275 $mg/cm^3$.

Yet another embodiment provides a method of treating mainstream tobacco smoke of the cigarette described above, which involves lighting the cigarette to form smoke and drawing the smoke through the cigarette, wherein the supported catalyst particles act as a catalyst and/or oxidant for the conversion of carbon monoxide to carbon dioxide.

While preferred embodiments have been described, it is to be understood that variations and modifications may be resorted to as will be apparent to those skilled in the art. Such variations and modifications are to be considered within the purview and scope of the claims as appended hereto.

What is claimed is:

1. A cut filler composition comprising tobacco and an admixture comprising catalyst particles and tobacco powder particles, wherein the catalyst particles are supported on the tobacco powder particles.

2. The cut filler composition of claim 1, wherein the catalyst particles comprise one or more metallic elements selected from the group consisting of Group IB, IIB, IIIB, IVB, VB, VIB, VIIB, VIII, IIIA and IVA elements of the Periodic Table of Elements.

3. The cut filler composition of claim 1, wherein the catalyst particles comprise:

copper manganese spinel and/or metal oxides selected from the group consisting of manganese oxide, iron oxide, copper oxide, cerium oxide and mixtures thereof; and/or catalyst particles with a specific surface area from about 10 to 2500 $m^2/g$; and/or catalyst particles that at least partially cover the surface of the tobacco powder particles; and/or catalyst particles with an average particle size of less than about 5 μm.

4. The cut filler composition of claim 1, wherein the admixture comprises:

a dry admixture; and/or from about 0.1 to 50 wt. % catalyst particles supported on tobacco powder particles.

5. The cut filler composition of claim 1, wherein the tobacco powder particles have an average particle size of less than 500 microns.

* * * * *